US007632138B2

(12) United States Patent
Hiramatsu

(10) Patent No.: US 7,632,138 B2
(45) Date of Patent: Dec. 15, 2009

(54) CONNECTOR AND A CONNECTOR ASSEMBLY

(75) Inventor: Hiroyuki Hiramatsu, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/180,613

(22) Filed: Jul. 28, 2008

(65) Prior Publication Data

US 2009/0029579 A1 Jan. 29, 2009

(30) Foreign Application Priority Data

Jul. 27, 2007 (JP) ..... 2007-195902

(51) Int. Cl.
*H01R 13/62* (2006.01)

(52) U.S. Cl. ..... 439/521

(58) Field of Classification Search ..... 439/521, 439/902, 468–466, 455, 473, 470
See application file for complete search history.

(56) References Cited

U.S. PATENT DOCUMENTS

| | | | | |
|---|---|---|---|---|
| 4,358,178 | A * | 11/1982 | Guy | 439/464 |
| 5,338,211 | A * | 8/1994 | Kodama et al. | 439/135 |
| 5,389,006 | A * | 2/1995 | Noschese | 439/354 |
| 5,897,392 | A * | 4/1999 | Takahashi et al. | 439/470 |
| 6,824,420 | B2 * | 11/2004 | Ushiro et al. | 439/455 |
| 7,351,094 | B2 * | 4/2008 | Miyamoto | 439/447 |

FOREIGN PATENT DOCUMENTS

JP 2003-45554 2/2003

* cited by examiner

*Primary Examiner*—Alexander Gilman
(74) *Attorney, Agent, or Firm*—Gerald E. Hespos; Anthony J. Casella

(57) ABSTRACT

A wire cover (60) is mounted on a rear part of a housing main body (21) to cover wires (50) drawn out from the rear surface of the housing main body (21). Cover locks (72) are provided on side walls (62) of the wire cover (60), and cover engaging portions (33) are provided on side surfaces of the housing main body (21). The cover locks (72) and the cover engaging portions (33) resiliently engage each other as the side walls (62) are resiliently deformed to hold the wire cover (60) on the housing main body (21). Detachment preventing pieces (76) are provided in parallel with the cover locks (72) on the side walls (62). The detachment preventing pieces (76) are accommodated in the receptacle when the housings (10, 20) are connected properly.

12 Claims, 9 Drawing Sheets

CONNECTOR AND A CONNECTOR ASSEMBLY

BACKGROUND OF THE INVENTION

1. Field of the Invention

The invention relates to a connector and a connector assembly.

2. Description of the Related Art

Japanese Unexamined Patent Publication No. 2003-45554 discloses a connector with a housing main body and wire cover that is mounted on a rear part of the housing main body. A group of wires drawn out from the rear surface of the housing main body are led in a specified direction while being covered by the wire cover. The wire cover includes a resiliently deformable cover lock that engages a cover engaging portion on the housing main body to hold the wire cover on the housing main body.

An external force on the above-described wire cover can deform the cover lock sufficiently to disengage the cover lock from the cover engaging portion so that the wire cover is detached from the housing main body.

The present invention was developed in view of the above situation and an object thereof is to prevent the detachment of a wire cover.

SUMMARY OF THE INVENTION

The invention relates to a connector with a housing that is connectable with a mating housing by fitting a main body of the housing into a receptacle of the mating housing. The housing main body is capable of accommodating one or more terminal fittings connected with one or more ends of respective wires. A wire cover is mounted on a part of the housing main body to at least partly cover the wires drawn out from a draw-out surface of the housing main body. At least one part of the wire cover is accommodated in the receptacle so as not to make loose movements when the housing is connected to the mating housing. Thus, detachment of the wire cover from the housing main body is prevented if an external force acts on the wire cover.

At least one cover lock is provided on at least one side wall of the wire cover and at least one cover engaging portion is provided on at least one side surface of the housing main body. The cover lock and the cover engaging portion are engaged resiliently with each other accompanied by the resilient deformation of the side wall to hold the wire cover on the housing main body.

The part of the wire cover to be accommodated in the receptacle constitutes a part of the side wall having the cover lock.

The wire cover may be detached from the housing main body due to the disengagement of the cover lock and the cover engaging portion if the side wall is deformed resiliently by an external force. However, the part of the wire cover accommodated in the receptacle prevents resilient deformation of the side wall. Thus, the cover lock and the cover engaging portion are kept engaged to prevent detachment of the wire cover.

The front end of the receptacle contacts the resiliently deformed part of the side wall in a connecting process if the two housings are connected incompletely with the wire cover. Thus, the wire cover is detached from the housing main body by an impact force resulting from the contact and the incompletely mounted state of the wire cover is known.

A retainer mount groove is formed in the side surface of the housing main body for receiving a retainer that retains the terminal fittings. The part of the wire cover accommodated in the receptacle has a depth to be accommodated in the depth of the retainer mount groove. Thus, there is no need to provide the housing main body with a special accommodation structure for accommodating the part of the wire cover. Further, the part of the wire cover to be accommodated within the depth of the retainer mount groove does not project from the side surface of the housing main body and, hence, it is not necessary to provide the receptacle with an escaping structure for avoiding interference with the part of the wire cover. As a result, the construction of the connector is simplified.

Leading ends of the part of the wire cover to be accommodated in the receptacle have tapered edges to ensure the smooth inserting the connector housing into the receptacle in the process of connecting the two housings.

The cover preferably comprises at least one backlash suppressing piece that can enter at least one entrance groove of the housing main body while having loose movements thereof prevented for preventing backlash of the cover. The backlash suppressing piece preferably is restrained at four sides by the surfaces of the entrance groove upon being inserted into the entrance groove.

The cover preferably comprises at least one projecting wall having a thick front stop that contacts the draw-out surface of the housing main body upon mounting the wire cover onto the housing main body. At least one thin backlash suppressing piece projects forward from the front end of the front stop.

A projecting distance of the backlash suppressing piece from the front stop preferably is shorter than half the depth of the entrance groove.

A projecting distance of the front stop preferably is substantially equal to that of a wall of the wire cover. Thus, the front end of the front stop and the front end of the wall can contact with the housing main body.

Most preferably, the cover comprises a wall being formed with at least one window hole so that the at least partly inserted state of the backlash suppressing piece in the entrance groove can be seen through the window hole.

The invention also relates to a connector assembly comprising the above-described connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention is described with reference to FIGS. 1 to 9. The connector has male and female housings 10, 20 connectable with each other and a wire cover 60 to be mounted on the female housing 20. In the following description, ends of the two housings 10, 20 to be connected are referred to as front ends concerning forward and backward directions.

Figure 7:
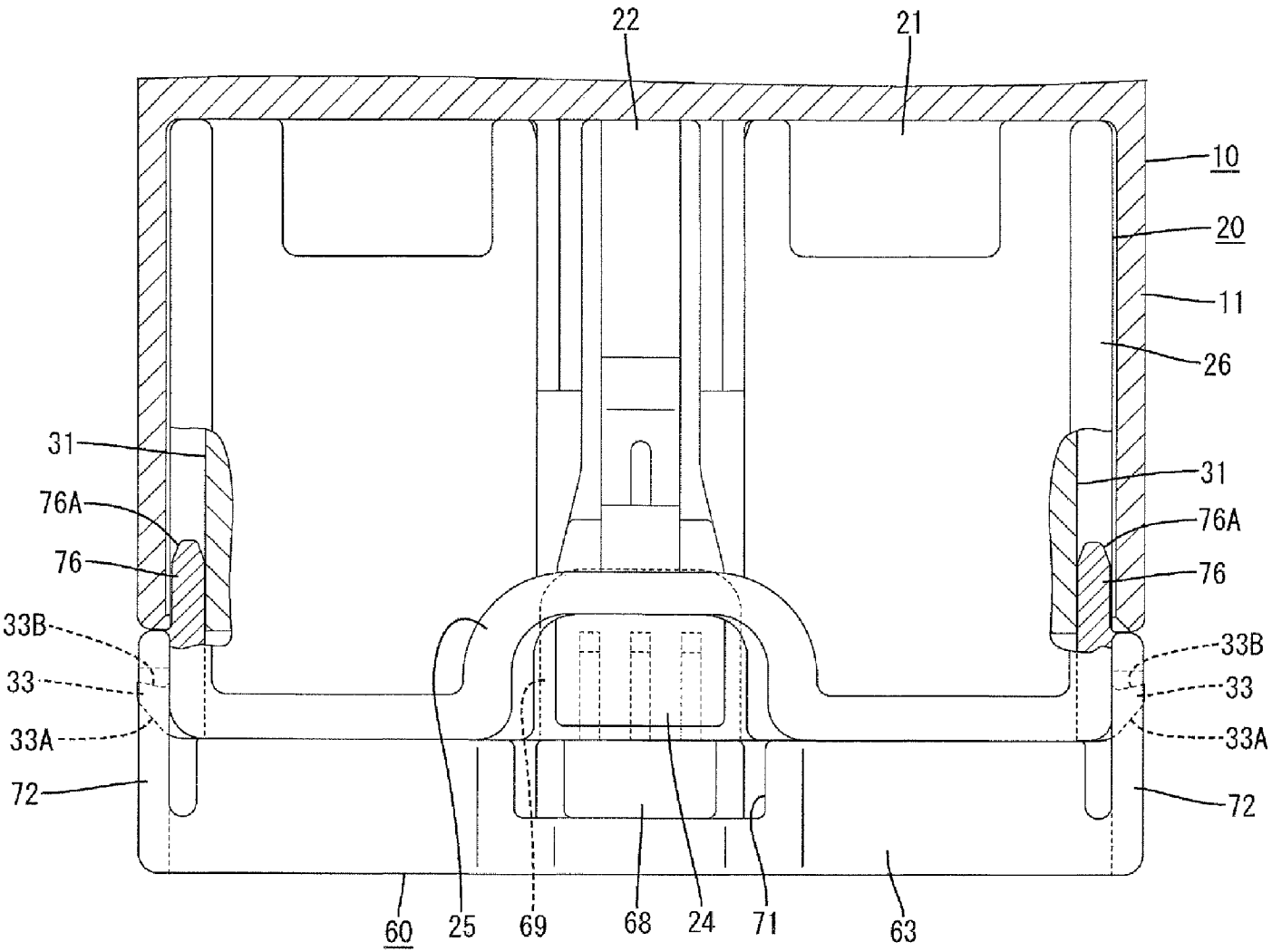
FIG. 7 is a plan view with an essential portion in section showing a state where two connector housings are properly connected.
Figure 8:
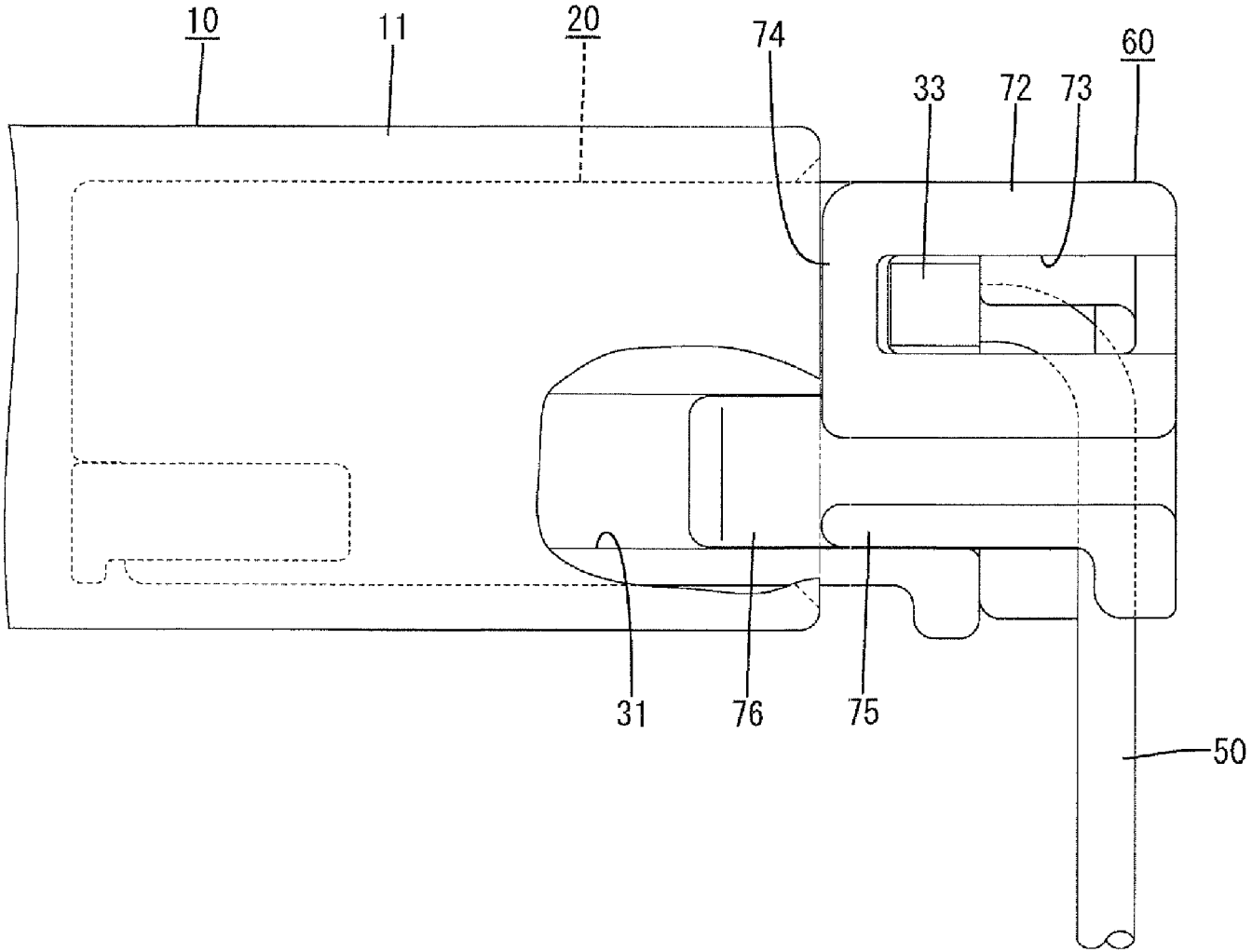
FIG. 8 is a plan view with an essential portion in section showing the state where the two connector housings are properly connected.

The male housing 10 is made e.g. of synthetic resin and includes a receptacle 11 substantially in the form of a wide rectangular tube as shown in FIGS. 7 and 8, and tabs of male terminal fittings (not shown) project into the receptacle 11. A lock portion (not shown) projects from the receptacle 11.

Figure 1:
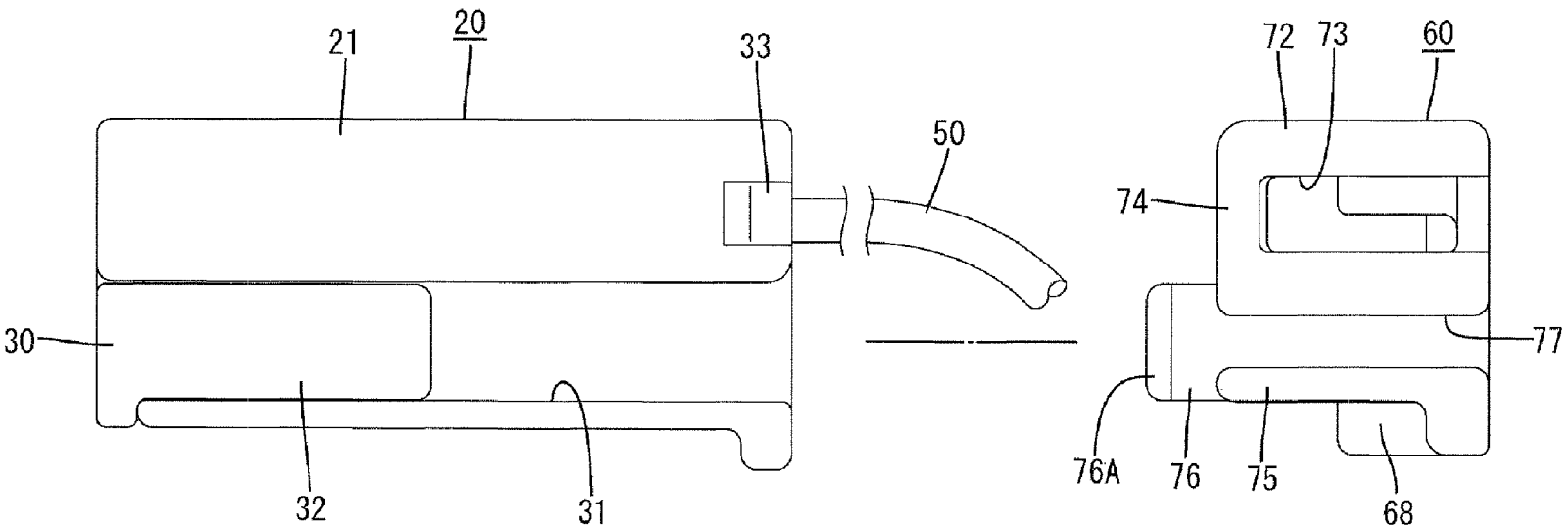
FIG. 1 is a side view showing a state before a wire cover is mounted on a housing main body in one embodiment.
Figure 5:
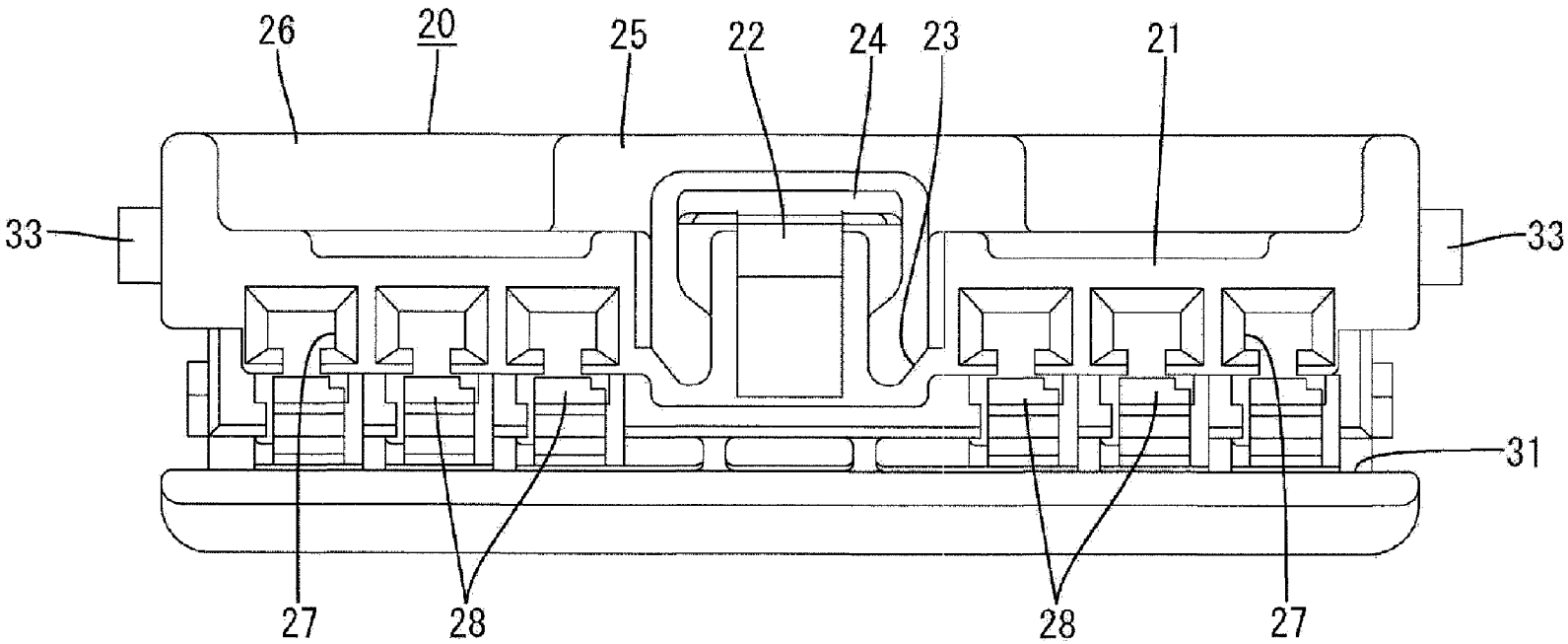
FIG. 5 is a front view of the housing main body.

The female connector housing 20 also is made e.g. of synthetic resin and includes a housing main body 21 in the form of a wide block having a shape to be fit into the receptacle 11. A resiliently deformable lock arm 22 projects on the top surface of the housing main body 21 as shown in FIGS. 1 and 5. The lock arm 22 extends substantially in forward and backward directions and locks the two housings 10, 20 in a connected state by the resilient engagement with the mating lock. The lock arm 22 is on the bottom surface of a recessed groove 23 formed in a widthwise intermediate part of the housing main body 21 and is accommodated in the recessed groove 23. An operable portion 24 is provided at the rear end of the lock arm 22 and is pressed to disengage the lock arm 22 from the lock. A bridge 25 crosses the recessed groove 23 near the rear end of the housing main body 21 while leaving a finger entrance area to the operable portion 24 to prevent an inadvertent unlocking operation from being performed on the operable portion 24. The bridge 25 is part of a surrounding rib 26 extending at substantially the same height along the opposite side edges and the rear end edge of the upper surface of the housing main body 21.

Three cavities 27 are formed in the housing main body 21 and are capable of accommodating respective female terminal fittings (not shown). The cavities 27 are arranged symmetrically and side by side at each of the left and right sides of the recessed groove 23. A resiliently deformable locking lance 28 is provided at an inner wall of each cavity 27, and the female terminal fitting properly inserted into the cavity 27 is retained primarily by the locking lance 28. The female terminal fittings are crimped into connection with ends of wires 50 and are provided in a one-to-one correspondence with the wires 50. Groups 50A of the wires 50 are drawn out from the rear surface of the housing main body 21, and the wire cover 60 bends the drawn-out wire groups 50A down and substantially normal to the longitudinal direction of the respective terminal fittings to define a draw-out direction of the wire groups 50A.

Figure 3:
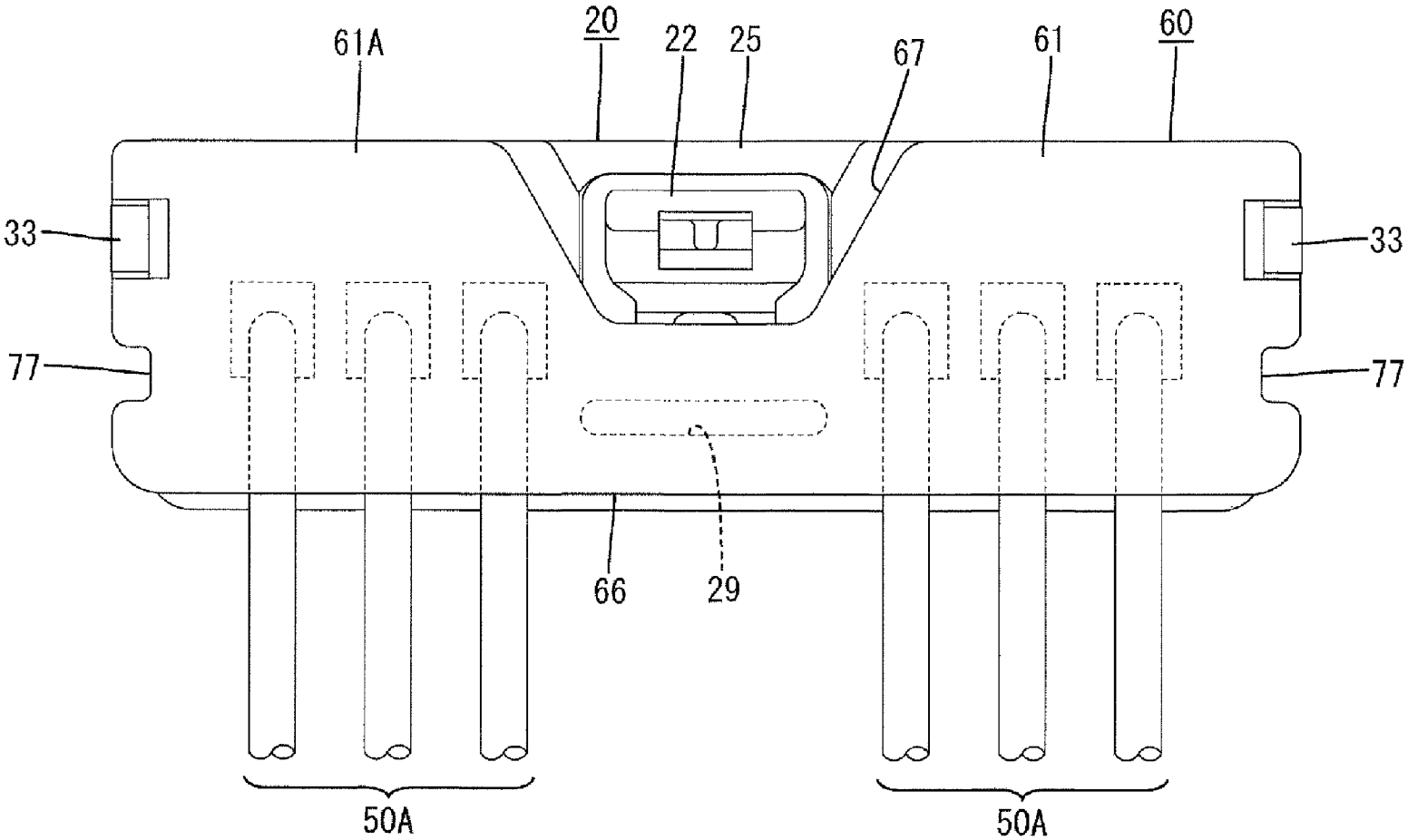
FIG. 3 is a rear view showing the state where the wire cover is mounted on the housing main body.
Figure 9:
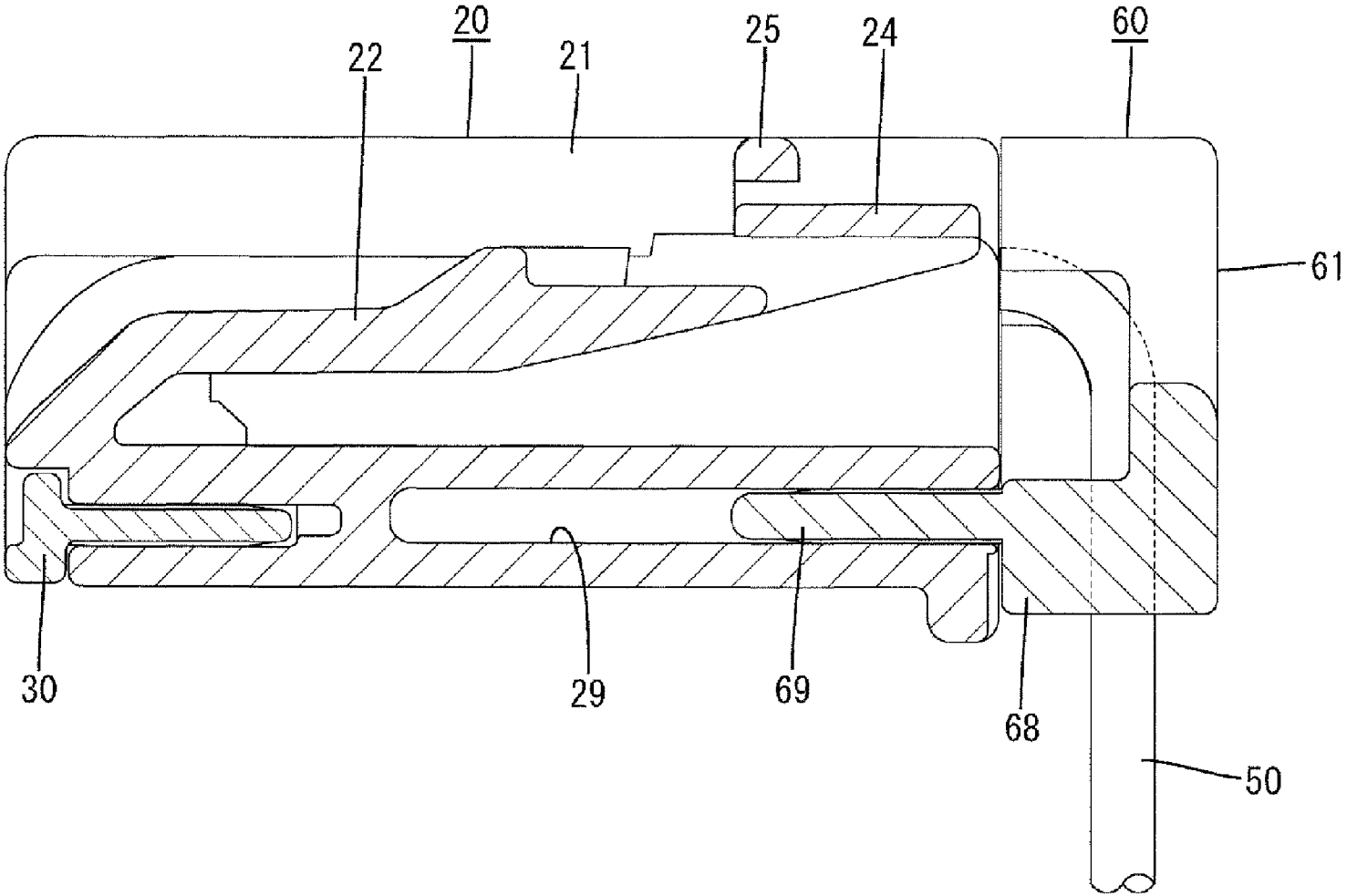
FIG. 9 is a side view in section showing a state where the wire cover is mounted on the housing main body.

An entrance groove 29 is formed in the rear surface of the housing main body 21 and defines a slit extending laterally at a position below the recessed groove 23 and between the left and right groups of the cavities 27, as shown in FIGS. 3 and 9. The entrance groove 29 has a closed end at a depth located more forward than a center of the housing main body 21 in forward and backward directions.

A retainer 30 is mounted to the front surface of the housing main body 21. Restricting pieces (not shown) project from the retainer 30 and enter deformation spaces for the locking lances 28 from the front for preventing resilient deformations of the locking lances 28 in an unlocking direction to secondarily retain the female terminal fittings. A retainer mount groove 31 is formed in the housing main body 21 to extend from the front surface to the opposite side surfaces. A front part of the retainer mount groove 31 communicates with the deformation spaces for the locking lances 28. The opposite side parts of the retainer mount groove 31 extend with the same width in forward and backward directions substantially in lower halves of the opposite side surfaces of the housing main body 21 for receiving opposite side walls 32 of the retainer 32. The side parts of the retainer mount groove 31 make openings in the rear surface of the housing main body 21.

Left and right cover engaging portions 33 are formed on the opposite side surfaces of the housing main body 21 at positions above the retainer mount groove 31 for holding the wire cover 60. The cover engaging portions 33 are at the rearmost end of the housing main body 21 and projects outwardly in width direction. As shown in FIG. 7, a slanted surface 33A is formed on the rear of each cover engaging portion 33 and are inclined forward towards the projecting ends, and a mounting operation of the wire cover 60 is guided by these slanted surfaces 33A. A locking surface 33B is formed on the front of each cover engaging portion 33 and is arched forward in an overhanging or undercut manner towards the projecting ends. The orientation of the locking surfaces 33B increases the mounting strength of the wire cover 60.

Figure 6:
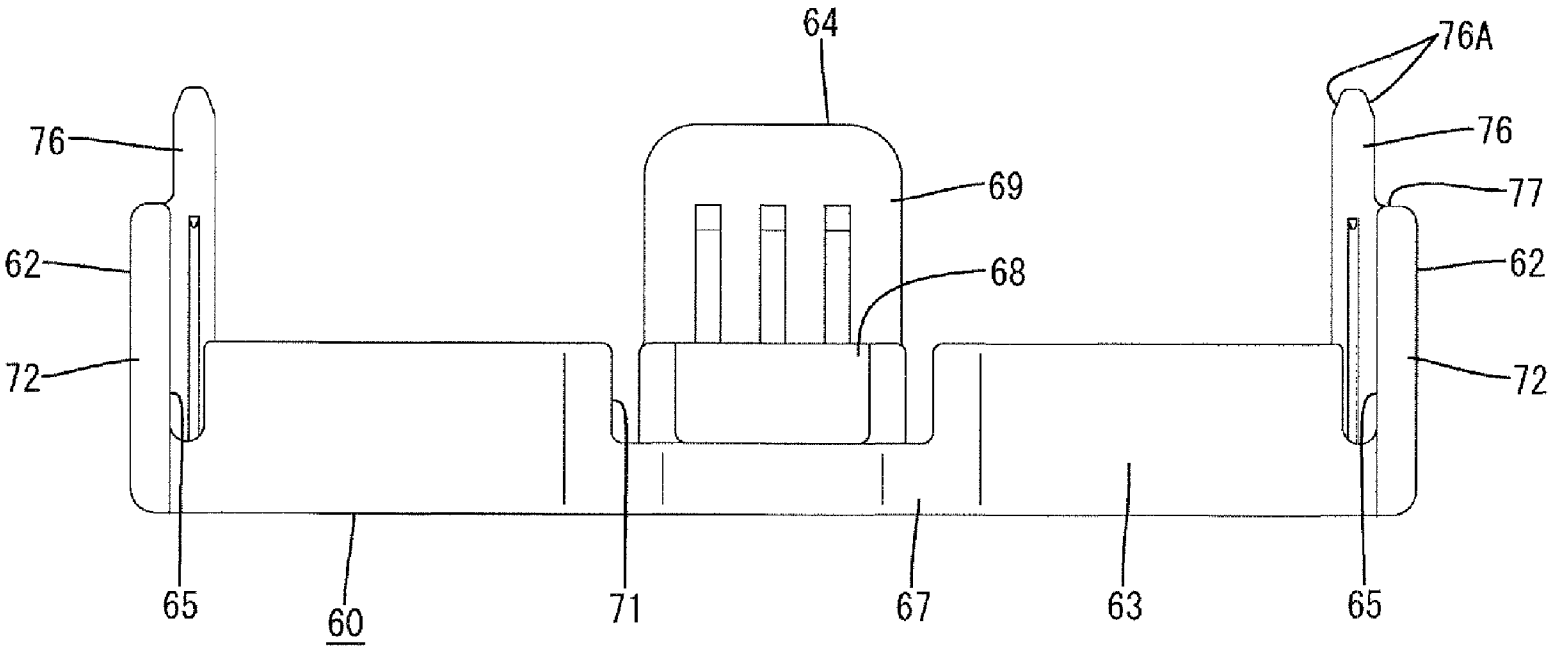
FIG. 6 is a plan view of the wire cover.

The wire cover 60 is made e.g. of synthetic resin, separate from the two housings 10, 20 and is detachably mounted to the rear part of the housing main body 21. As shown in FIGS. 1, 3 and 6, the wire cover 60 is substantially cap-shaped and includes a wide wire pressing plate 61 for covering substantially the entire rear surface of the housing main body 21. Left and right side walls 62 project forward from the opposite lateral edges of the wire pressing plate 61, an upper wall projects forward from the upper end of the wire pressing plate 61 and a projecting wall 64 projects forward from a substantially widthwise central part of the bottom end of the wire pressing plate 61. Left and right slits 65 are formed between the upper wall 63 and the opposite side walls 62.

The front surface of the wire pressing plate 61 defines a guiding surface (not shown) for contacting the wire groups 50A drawn out from the rear surface of the housing main body 21 and bending the wire groups 50A substantially normally down. A pressing surface 61A faces rearwardly on the wire pressing plate 61 and can be pressed (e.g. by hand or the fingers) for mounting the wire cover 60 onto the housing main body 21. Wire draw-out openings 66 open downwardly at the opposite sides of the projecting wall 64 and between the wire pressing portion 61 and the housing main body 21, and the wire groups 50A extend downward through the wire draw-out openings 66. A depression 67 is formed at a substantially widthwise central part of the upper wall 63 of the wire pressing portion 61 and is substantially continuous with the recessed groove 23 of the housing main body 21. The depression 67 defines a finger entrance area for operating the operable portion 24 of the lock arm 24.

The projecting wall 64 has a thick front stop 68 that contacts the rear surface of the housing main body 21 upon mounting the wire cover 60 onto the housing main body 21. A thin backlash suppressing piece 69 projects forward from the front end of the front stop 68.

The backlash suppressing piece 69 is a wide plate having a cross section substantially corresponding to the entrance groove 29 of the housing main body 21. As shown in FIG. 9, a projecting distance of the backlash suppressing piece 69 from the front stop 68 is shorter than half the depth of the entrance groove 29 and the backlash suppressing piece 69 is restrained at four sides by the surfaces of the entrance groove 29 upon being inserted into the entrance groove 29. A projecting distance of the front stop 68 from the front surface of the wire pressing portion 61 is substantially equal to the projecting distance of the upper wall 63. Thus, the front ends of the front stop 68 and the upper wall 63 contact the rear surface of the housing main body 21. The upper wall 63 has a window 71 at a position corresponding to the projecting wall 64, and an inserted state of the backlash suppressing piece 69 in the entrance groove 29 can be seen through the window 71.

The opposite side walls 62 are substantially plate-like and are resiliently deformable outwardly in the width direction in the process of mounting the wire cover 60 onto the housing main body 21. Left and right cover locks 72 are provided at upper parts of the opposite side walls 62 for engaging the cover engaging portions 33 to hold the wire cover 60 on the housing main body 21. The cover locks 72 are in the form of rectangular frames and project forward so that the front ends thereof are located more forward than the front ends of the upper wall 63 and the projecting wall 64. A rearwardly open lock groove 73 is formed in each cover lock 72 for receiving the cover engaging portion 33. A main locking part 74 extends substantially vertically at a part of the cover lock 72 before the lock groove 73 to face the locking surface 33B of the cover engaging portion 33 in a detaching direction of the wire cover 60 upon mounting the wire cover 60 onto the housing main body 21.

Ribs 75 are provided on the opposite side walls 62 and extend substantially parallel with the cover locks 72 at positions vertically below the cover locks 72. A projecting distance of the ribs 75 substantially equals a projecting distance of the cover locks 72, and the front ends of the ribs 75 and the cover locking portions 72 are at substantially the same positions in forward and backward directions. The front end of the receptacle 11 substantially simultaneously contacts the front ends of the ribs 75 and the front ends of the main locking parts 74 when the two housings 10, 20 are connected properly.

Plate-like detachment preventing pieces 76 are provided on the opposite side walls 62 right below the cover locks 72 and substantially parallel to the cover locks 72. The detachment preventing pieces 76 project so that their front ends are more forward than the front ends of the cover locks 72 and are interlocked with movements of the cover locks 72. The detachment preventing pieces 76 are more inward than the ribs 75 and the cover locks 72 while defining steps 77 together with the ribs 75 and the cover locks 72. The detachment preventing pieces 76 can enter the opposite side parts of the retainer mount groove 31 of the housing main body 21 upon mounting the wire cover 60 onto the housing main body 21, and are accommodated in the receptacle 11 so as not to make loose movements upon properly connecting the two housings 10, 20. The maximum plate thickness of each detachment preventing piece 76 is substantially equal to or slightly smaller than the depth of the retainer mount groove 31 so that the detachment preventing pieces 76 are accommodated substantially completely in the retainer mount groove 31. Further, tapered cut edges 76A are formed at the leading ends of the detachment preventing pieces 76 for reducing the plate thickness to ensure a smooth insertion of the housing 20 into the receptacle 11 while connecting the two housings 10, 20.

Female terminal fittings connected respectively with wires 50 are inserted into the cavities 27 of the housing main body 21. The wire cover 60 then is mounted on the housing main body 21 from behind. In the mounting process, the wire groups 50A are bent substantially normally down along the guiding surface of the wire pressing portion 61 and are drawn out downward through the wire draw-out openings 66. Further, in the mounting process, the main locking parts 74 of the cover locks 72 move onto the cover engaging portions 33. Thus, the substantially entire side walls 62 including the cover locks 72 deform resiliently out in the width direction with the connected ends thereof with the wire pressing portion 61 as supports. Substantially simultaneously with the start of the riding movements of the cover locks 72 onto the cover engaging portions 33, the backlash suppressing piece 69 enters the entrance groove 29 while having loose movements thereof prevented, thereby ensuring stability in the mounting posture of the wire cover 60.

Figure 2:
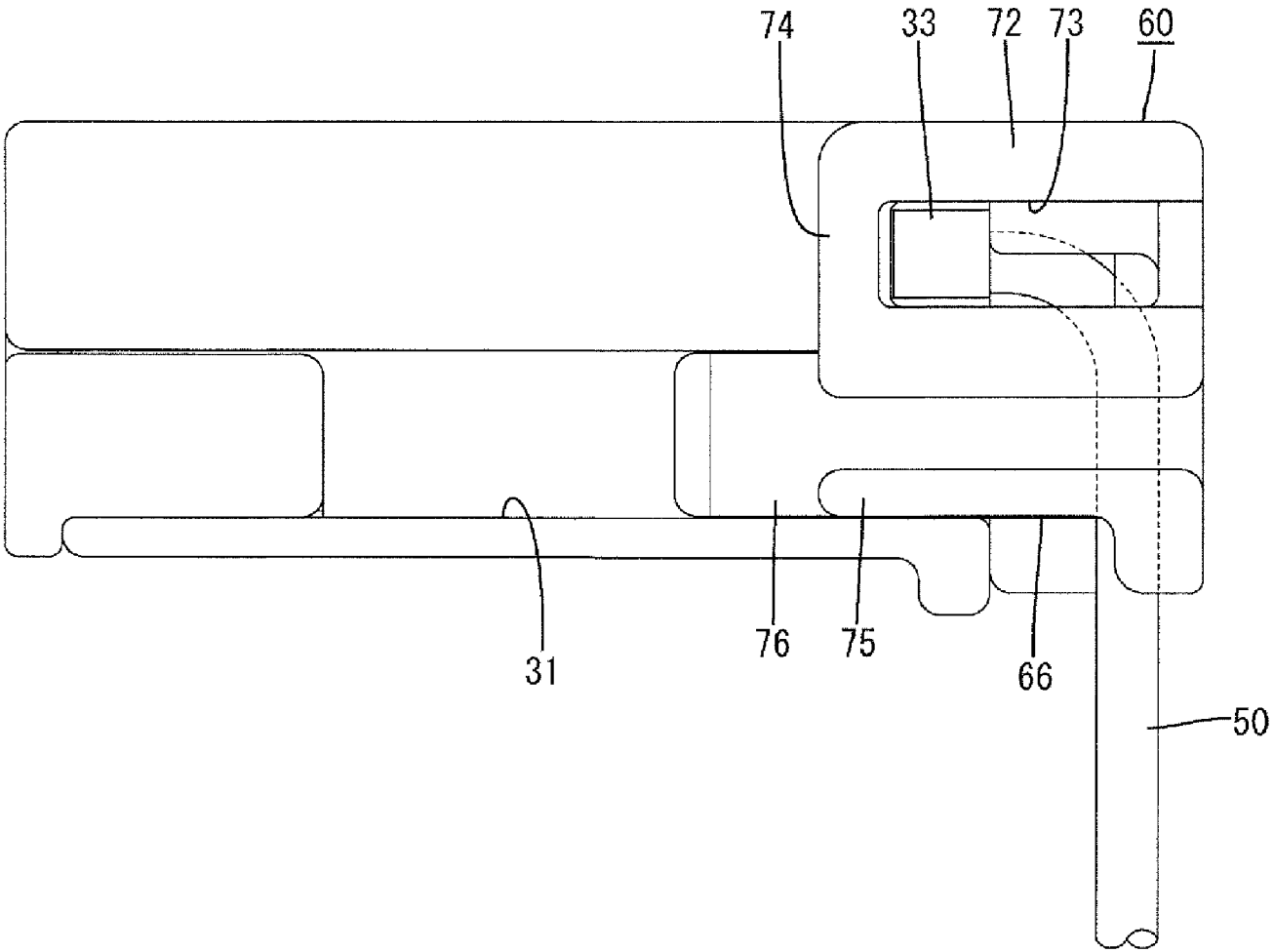
FIG. 2 is a side view showing a state where the wire cover is mounted on the housing main body.
Figure 4:
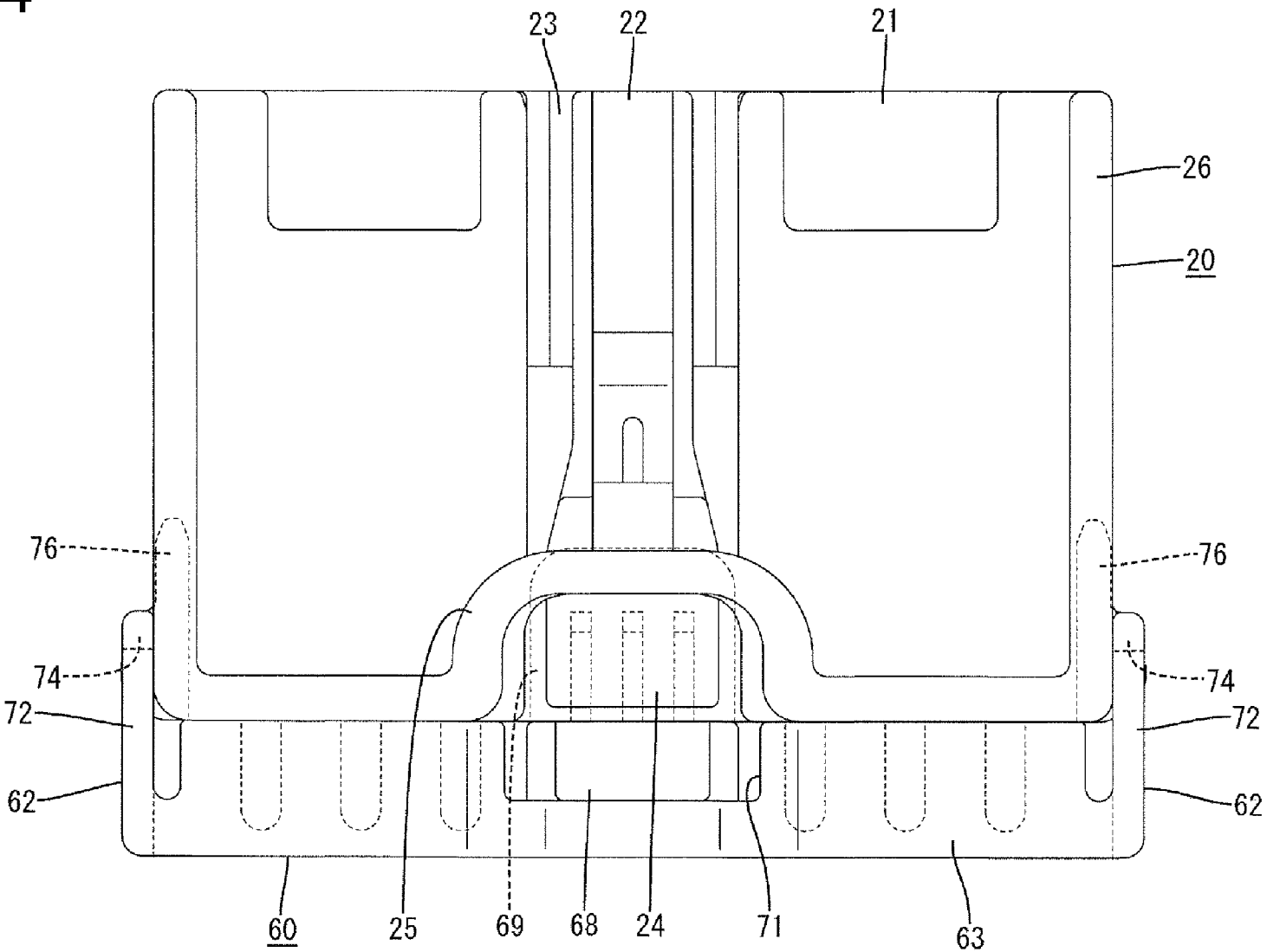
FIG. 4 is a plan view showing the state where the wire cover is mounted on the housing main body.

The opposite side walls 62 resiliently restore when the wire cover 60 is mounted properly, and the cover engaging portions 33 are fit into the lock grooves 73 of the cover locks 72 to engage with the cover locks 72 as shown in FIGS. 2 to 4. In this state, any further forward movement of the wire cover 60 is prevented by the substantially simultaneous contact of the front end of the upper wall 63 and the front end of the front stop 68 with the rear surface of the housing main body 21. Thus, the mounting posture of the wire cover 60 is specified. The detachment preventing pieces 76 enter the retainer mount groove 31 of the housing main body 21 from outer sides as the opposite side walls 62 are restored. Thus, the upper and lower end surfaces of the detachment preventing pieces 76 contact the upper and lower end surfaces of the retainer mount groove 31 to prevent vertical loose movements of the detachment preventing pieces 76.

Subsequently, the housing main body 21 mounted with the wire cover 60 is inserted into the receptacle 11 of the male housing 10, thereby starting the connecting operation of the two housings 10, 20. When the two housings 10, 20 reach a proper connection position, the housing main body 21 is fit to a proper depth in the receptacle 11 and the front end of the receptacle 11 covers substantially the entire detachment preventing pieces 76 from the outer sides. In this state, as shown in FIGS. 7 and 8, the outer surfaces of the detachment preventing pieces 76 are arranged to contact the inner surfaces of the receptacle 11 and the inner surfaces thereof are arranged to contact with the groove bottom surfaces of the retainer mount groove 31. As a result, the detachment preventing pieces 76 are sandwiched between the receptacle 11 and the housing main body 21 so as not to make loose movements.

An external force could act on the wire cover 60 in a direction to disengage the cover locks 72 from the cover engaging portions 33 while the two housings 10, 20 are connected properly. However, the detachment preventing pieces 76 interfere with the receptacle 11 to prevent deformations of the side walls 62 in directions away from each other. Thus, the cover locks 72 and the cover engaging portions 33 remain engaged.

The wire cover 60 is mounted on the housing main body 21 to a substantially proper depth and the detachment preventing pieces 76 are fit properly in the retainer mount groove 31 of the housing main body 21. Thus, the receptacle 11 and the detachment preventing pieces 76 do not interfere with each other in the connecting process of the two housings 10, 20 and the connecting operation of the two housings 10, 20 proceeds smoothly proceeds.

The wire cover 60 could be mounted incompletely on the housing main body 21 without reaching the proper depth. In this situation, the main locking parts 74 of the cover locks 72 remain on the cover engaging portions 33 and the leading ends of the detachment preventing pieces 76 project out in width direction from the side surfaces of the housing main body 21. If the connecting operation of the two housings 10, 20 proceeds in this state, the front end of the receptacle 11 contacts the detachment preventing pieces 76 in the connecting process and a resulting impact force causes detaches the wire cover 60 from the housing main body 21. The incompletely mounted state of the wire cover 60 can be known in this way. Thus, the wire cover 60 is mounted on the housing main body 21 again and the connecting operation of the two connector housings 10, 20 is resumed.

The detachment preventing pieces 76 are accommodated in the receptacle 11 so as not to make loose movements when the two housings 10, 20 are connected properly. Thus, the wire cover 60 will not detach from the housing main body 21 even if an external force acts on the wire cover 60.

The detachment preventing pieces 76 are provided on the side walls 62 that include the cover locks 72 and the deformations of the side walls 62 are prevented by the mutual interference of the detachment preventing pieces 76 and the receptacle 11 so that the cover locks 72 are not likely to disengage from the cover engaging portions 33.

An operator could try to connect the two housings 10, 20 when the wire cover 60 is mounted incompletely. However, the front end of the receptacle 11 will contact the resiliently deformed detachment preventing pieces 76 in the connecting process. Thus, the wire cover 60 will be detached from the housing main body 21 by an impact force resulting from the contact and the incompletely mounted state of the wire cover 60 can be known. In this way, the wire cover 60 will not be left incompletely mounted.

The detachment preventing pieces 76 are accommodated in the existing retainer mount groove 31. Thus, it is not necessary to provide the housing main body 21 with a special accommodation structure for accommodating the detachment preventing pieces 76. Further, the detachment preventing pieces 76 have a depth as to be accommodated within the depth of the retainer mount groove 31 without projecting from the side surfaces of the housing main body 21. Hence, it is not necessary to provide the receptacle 11 with an escaping structure for avoiding the interference with the detachment preventing pieces 76. As a result, the construction of the entire connector can be simplified.

Further, the backlash of the wire cover 60 is suppressed by the entrance of the backlash suppressing piece 69 into the entrance groove 29. Thus, the wire cover 60 is less likely to be detached from the housing main body 21. In this case, the backlash suppressing piece 69 enters the entrance groove 29 while having loose movements thereof prevented substantially simultaneously with the interference of the cover locks 72 and the cover engaging portions 33. Therefore the mounting operation of the wire cover 60 is guided to improve a locking feeling.

The invention is not limited to the above described and illustrated embodiment. For example, the following embodiments are also embraced by the technical scope of the present invention as defined by the claims.

The detachment preventing pieces may be provided on parts of the wire cover other than on the side walls.

The detachment preventing pieces may be provided on the cover locks.

The detachment preventing pieces may be brought into contact with parts of the side surfaces of the housing main body other than the retainer mount groove.

Contrary to the above embodiment, the cover engaging portions may be resiliently deformable and the cover locking portions may be fixed.

The retainer may be of the side type to be mounted into a side surface of the housing main body.

What is claimed is:

1. A connector, comprising:

a housing connectable with a mating housing by fitting a housing main body of the housing into a receptacle of the mating housing, the housing main body having a side surface formed with at least one cover engaging portion; and a wire cover mounted on a part of the housing main body and covering wires drawn out from a draw-out surface of the housing main body, the wire cover having at least one side wall formed with a cover lock, the cover lock and the cover engaging portion being engaged with each other by a resilient deformation of the side wall for holding the wire cover on the housing main body, part of the side wall being disposed for accommodation in the receptacle so as not to make loose movements when the housing is connected to the mating housing.

2. The connector of claim 1, wherein the front end of the receptacle contacts a deformed part of the side wall in a connecting process if the two housings are connected while the wire cover is mounted incompletely.

3. The connector of claim 1, wherein tapered cut edges are formed at leading ends of the part of the wire cover in the receptacle to ensure smooth insertion of the housing into the receptacle.

4. A connector assembly comprising the connector of claim 1 and a mating connector connectable therewith.

5. A connector, comprising:

a housing connectable with a mating housing by fitting a housing main body of the housing into a receptacle of the mating housing, wherein a retainer mount groove is formed in a side surface of the housing main body for receiving a retainer for retaining terminal fittings in the housing; and a wire cover mounted on a part of the housing main body and covering wires drawn out from a draw-out surface of the housing main body, the wire cover having at least one part disposed for accommodation in the receptacle so as not to make loose movements when the housing is connected to the mating housing, the part of the wire cover to be accommodated in the receptacle has a depth to be accommodated in the retainer mount groove.

6. The connector of claim 5, wherein the wire cover has at least one side wall formed with a cover lock, and wherein the housing main body has a side surface formed with at least one cover engaging portion, the cover lock and the cover engaging portion being engaged with each other by a resilient deformation of the side wall for holding the wire cover on the housing main body.

7. The connector of claim 6, wherein the part of the wire cover accommodated in the receptacle constitutes a part of the side wall.

8. A connector, comprising:

a housing connectable with a mating housing by fitting a housing main body of the housing into a receptacle of the mating housing; and a wire cover mounted on a part of the housing main body and covering wires drawn out from a draw-out surface of the housing main body, the wire cover having at least one part disposed for accommodation in the receptacle so as not to make loose movements when the housing is connected to the mating housing, wherein the cover comprises at least one backlash suppressing piece for entering at least one entrance groove of the housing main body while having loose movements thereof prevented, so as to prevent a backlash of the cover, the backlash suppressing piece being restrained at four sides by surfaces of the entrance groove.

9. The connector of claim 8, wherein the cover has a wall formed with at least one window so that an inserted state of the backlash suppressing piece in the entrance groove is visible through the window.

10. A connector, comprising:

a housing connectable with a mating housing by fitting a housing main body of the housing into a receptacle of the mating housing; and a wire cover mounted on a part of the housing main body and covering wires drawn out from a draw-out surface of the housing main body, the wire cover having at least one part disposed for accommodation in the receptacle so as not to make loose movements when the housing is connected to the mating housing, wherein the cover comprises at least one projecting wall having a thick front stop contacting the draw-out surface of the housing main body when the wire cover is mounted on the housing main body, and at least one thin backlash suppressing piece projecting forward from the front end of the front stop.

11. The connector of claim 10, wherein a projecting distance of the backlash suppressing piece from the front stop is less than half a depth of the entrance groove.

12. The connector of claim 10, wherein a projecting distance of the front stop is substantially equal to a projecting distance of a wall of the wire cover, so that front end of the front stop and the wall substantially contact the housing main body.

* * * * *